US005511268A

United States Patent [19]

Albus et al.

[11] Patent Number: 5,511,268

[45] Date of Patent: Apr. 30, 1996

[54] CONSTRUCTION OF LARGE STRUCTURES BY ROBOTIC CRANE PLACEMENT OF MODULAR BRIDGE SECTIONS

[75] Inventors: James S. Albus, Kensington, Md.; Ken Goodwin, Alexandria, Va.; Yair Tene, N. Potomac, Md.

[73] Assignee: The United States of America as represented by the Secretary of Commerce, Washington, D.C.

[21] Appl. No.: 286,965

[22] Filed: Aug. 8, 1994

[51] Int. Cl.[6] ..... E01D 15/12

[52] U.S. Cl. ..... 14/77.1; 212/312; 212/324

[58] Field of Search ..... 212/205, 214, 212/215, 216, 217, 218, 219; 14/77.1

[56] References Cited

U.S. PATENT DOCUMENTS

| | | | |
|---|---|---|---|
| 3,027,633 | 8/1955 | Murphy . | |
| 3,385,455 | 6/1966 | Pont . | |
| 3,448,511 | 6/1969 | Suter | 14/77.1 X |
| 3,571,835 | 3/1971 | Buechler . | |
| 3,845,515 | 11/1974 | Gelhard et al. . | |
| 3,902,212 | 9/1975 | Muller . | |
| 4,282,978 | 8/1981 | Zambon . | |
| 4,666,362 | 5/1987 | Landsberger et al. . | |
| 4,825,492 | 5/1989 | Zehavi et al. . | |
| 4,827,688 | 5/1989 | Tene . | |
| 4,883,184 | 11/1989 | Albus . | |
| 4,907,390 | 3/1990 | Tene . | |

FOREIGN PATENT DOCUMENTS

| | | | |
|---|---|---|---|
| 0102900 | 9/1982 | European Pat. Off. . | |
| 0076597 | 4/1983 | European Pat. Off. . | |
| 0164936 | 12/1985 | European Pat. Off. . | |
| 1558417 | 1/1969 | France | 14/77.1 |
| 1249307 | 9/1967 | Germany | 14/77.1 |
| 1-310003 | 12/1989 | Japan . | |
| 908989 | 4/1980 | U.S.S.R. . | |
| 1096328A | 4/1982 | U.S.S.R. . | |

*Primary Examiner*—William P. Neuder
*Attorney, Agent, or Firm*—Oliff & Berridge

[57] ABSTRACT

A system for rapid, cost-effective construction of highway bridges, traffic overpasses and bypasses, and causeways over water or wetlands utilizes light-lift crane structures together with modular, light-lift bridge sections and an enhanced stabilized crane, using controlled cables, to improve the safety and efficiency of the construction process. Stabilization of the payload against pendulation and rotation enables safe operation in harsh environmental situations such as wind. The construction system utilizes continuous site assembly processes for building bridges and causeways from repetitive modular elements. In some embodiments, the system uses the payload (one or more modular bridge sections) as a component of a stable lifting and positioning system, thereby eliminating the need for heavy auxiliary lifting equipment such as spreader bars and platforms. Lifting cables of the crane are directly attached to the bridge payload, which becomes part of the lifting system during placement. Other embodiments utilize installed modular elements as a staging platform for constructing subsequent modular elements.

20 Claims, 14 Drawing Sheets

CONSTRUCTION OF LARGE STRUCTURES BY ROBOTIC CRANE PLACEMENT OF MODULAR BRIDGE SECTIONS

BACKGROUND OF THE INVENTION

The present invention is related to systems and methods of constructing highway bridges, traffic overpasses, causeways and the like, and more particularly, to a bridge constructing system using light weight lifting equipment and modular light weight structural elements, wherein the system integrates the lifting equipment with the structure being erected using the structure as a crane platform.

Construction of highway bridges and causeways requires special high capacity lifting equipment, typically cranes. In most cases, lifting is performed by cables or hydraulic jacks, providing three or one degrees of freedom movement, respectively. Precise load positioning and orientation of the load (roll, pitch and yaw) is achieved by pulling with auxiliary tie lines or pushing with poles, jacks or other external devices.

Lifting, carrying and final positioning of a payload that is not fully constrained results in pendulation and rotation of the payload, which reduces safety, requires more time to damp motion, and in harsh environmental situations, such as high winds, may cause shutdown and postponement of the lifting operation.

Feasibility, cost and construction time for erecting highway bridges and causeway structures is typically governed by the assembly method, capacity of available lifting equipment, weight and number of the structural elements, organization of a staging-storage area and transporting the structural elements and lifting equipment from the production site to the erection site.

Use of large preassembled structural elements can substantially reduce construction time and cost. However, handling of the large structural elements typically requires heavy lifting equipment, such as cranes having spreader bars. If the assembly cranes are heavier than the load that the bridge or causeway is intended to carry, the assembled structure may have to be overdesigned to support the assembly equipment.

The following publications are related to construction of bridge structures.

U.S. Pat. No. 3,845,515 to Gelhard et al. discloses a system for self-advancing construction of a conduit line. A railway is mounted on each side of the conduit. An assembly scaffolding capable of motion is suspended from the rails and is provided with a progressing erection component cantilevered to overhang the most forward assembled conduit section. The scaffolding accepts construction components and progressively erects the components along an intended route. The assembly scaffold is comprised of several connected, mutually supported and series-arrayed assembly sections. The front section of the assembly structure is developed into a cantilevered erecting section, while the most rearward assembly section is developed into a cantilevered material receiving section. Sections in between the front and rear cantilever sections are provided with controlled suspensions. An assembly scaffold consisting of several sections is thus suspended from its middle sections on travel rails of the previously erected pipe railroad section, and may be supplied with construction material from the rear. The materials are then transported to the front progressing sections of the structure where they are used by the cantilevered construction equipment to construct a further forward section of the pipe railroad. When construction of that section is completed, the entire assembly scaffold may move forward by the corresponding new segment, and a new section may be begun.

U.S. Pat. No. 3,385,455 to Dal Pont discloses an apparatus for lifting, horizontally transporting and installing heavy loads, such as metal lattice trusses, between spaced apart vertical support points. The apparatus comprises spaced apart first and second vertical support means against which rests each end of a horizontally extending boom and respective tackle means supported from spaced apart points along the boom. The boom and support means constitute a rigid stationary structural assembly while a load is being moved between the vertical support points. The assembly is transferable as a unit to other locations.

U.S. Pat. No. 4,282,978 to Zambon discloses a bridge crane comprising a framework consisting of a pair of parallel trusses interconnected by end portals and long enough to extend across three piers. Each truss has a bottom stringer formed on its underside with tracks engaged above each pier by rollers mounted on a pair of rocker arms, which are part of an undercarriage movable on transverse guide rails. Top stringers of the trusses support a trolley carrying hoists for raising and lowering transported castings. Longitudinal movement of the framework relative to the piers is brought about by a motor-driven capstan carried on the framework.

U.S. Pat. No. 3,902,212 to Muller discloses a device for use in building the superstructure of a multispan civil engineering work, such as a bridge or elevated road. The superstructure comprises at least one two-arm beam extending in a longitudinal direction substantially symmetrically on both sides of a previously erected pier. The device is comprised of a raised elongated scaffold E having a median support adapted to rest on the pier. The scaffold includes booms 1, 2 and 3. The booms 1 and 2 constitute rolling tracks for carriages 4 and 5.

European Publication 0 102 900 A2 discloses a beam positioning system having two parallel horizontal frames spanning over three columns. Each frame has a top rolling track for mobile bogies that move astride the frames and carry beam lifters. Each frame has a parallel bottom rolling track for rollers at the top of each column.

Japanese Publication 1-310003 (A) discloses a bridge building method using a traveling frame lockable on an existing beam, a lifter type crane, and a means to hang/support a beam block from the lifter type crane.

Soviet Publication SU 908989 discloses a gantry type bridge erection crane including a load carriage supporting beam 2, hinged and fixed legs 8 and 10 and an operating mechanism. After bridge supports and beams 12 and 13 are erected, crane columns 7, in the next span are jacked up and mounted on the erected bridge beams. The crane beam is then transferred to a new erection position, the crane columns lowered, and freed temporary supports 4 moved forward.

Soviet Publication SU 1096328 A discloses a bridge span assembly method using mobile support gantries of adjustable height.

U.S. Pat. No. 3,027,633 to Murphy discloses a method and apparatus for bridge construction in which a lightweight, temporary erection span 11 is erected on a barge 12, hoisted into position between two bridge piers, and used as a working platform for erecting a bridge span. The method includes a deck traveler 17 equipped with two stiff-leg derricks 17*a* and 17*b* mounted on a completed bridge span 18 and moving on skid beams mounted on the upper floor beams of the completed bridge span.

U.S. Pat. No. 3,571,835 to Buechler discloses an apparatus for concreting multiple section elevated structures. The apparatus comprises two girders that are movable relative to one another. One of the girders is a scaffold girder, and the other is an advancing girder that supports the scaffold girder as it is advanced.

SUMMARY OF THE INVENTION

It is an object of the present invention to provide an improved construction system and method that overcomes the above-described problems.

It is another object of the invention to provide an improved system for rapid, safe construction of highway bridges, overpasses, bypasses and causeways.

These and other objects of the invention are achieved by providing a crane capable of lifting and carrying modular bridge sections for overpass bridge construction, including a first supporting leg frame including a first pair of supporting legs, each of the legs including structure providing mobility of the crane and having a first length, a second supporting leg frame including a second pair of supporting legs, each of the legs including structure providing mobility of the crane and having a second length, longer than the first length, and a beam or truss connected between the first and second pairs of supporting leg frames, the beam or truss supporting heavy-lift corner cables capable of lifting and carrying the modular bridge sections. The first supporting leg frame is movable on an installed bridge section fixed to an existing section, and the second supporting leg frame is movable on the existing section.

The crane may also include at least one light-lift platform movably supported by the frame and capable of assembling the modular bridge sections. Four to six heavy-lift corner cables, each driven by a winch may be provided, wherein each of the cables is disposed at a corner section of the crane. At least one of the first and second supporting leg frames may be adjustable.

In accordance with another aspect of the invention, there is provided a lifting system including a frame and a plurality of cables for lifting and carrying a payload, wherein the cables are arranged to support the payload in six degrees of freedom, and the payload is used as a lifting platform.

In accordance with yet another aspect of the invention, there is provided a method of constructing a bridge structure using a cantilever crane, the cantilever crane including structure capable of lifting and carrying modular bridge sections, and the method including the steps of:

(a) assembling an initial bridge section having a predetermined length;

(b) installing the initial bridge section;

(c) placing the crane on the initial bridge section;

(d) assembling with the crane a subsequent bridge section using one of the initial bridge section and a previous subsequent bridge section as a staging platform;

(e) lifting the subsequent bridge section with the crane and stabilizing the subsequent bridge section;

(f) moving and carrying the subsequent bridge section to a next position;

(g) attaching the subsequent bridge section to the bridge structure; and (h) repeating steps (d) through (g) until the bridge structure is completely constructed.

The crane may include at least one or more light-lift platform, wherein the lifting and stabilizing step includes stabilizing the subsequent bridge section in six degrees of freedom. The crane may further include a plurality of heavy-lift corner cables, wherein the lifting step comprises securing the heavy-lift corner cables to the subsequent bridge section and lifting the subsequent bridge section with the cables.

The moving and carrying step and the attaching step may comprise positioning and attaching spudwells and pilings to an end of the subsequent bridge section.

In addition, the assembling step may include assembling two skeleton sections on top of the initial bridge section, wherein the placing step comprises placing the crane on the sides of the skeleton sections such that the crane supports each of the skeleton sections on opposite sides thereof, each of the skeleton sections including legs with spud cans displaceable between a transport position and an extension position, and wherein prior to the attaching step, the method including lowering the legs from the transport position to the extension position.

In accordance with yet another aspect of the invention, there is provided a method of constructing a bridge structure using a crane, the crane including structure capable of lifting and carrying modular bridge sections, the method including the steps of:

(a) assembling an initial bridge section having a predetermined length;

(b) installing the initial bridge section;

(c) assembling two skeleton bridge sections on the initial bridge section, the two skeleton bridge sections each having supporting legs with spud cans displaceable between a transport position and an extension position;

(d) placing the crane on the two skeleton bridge sections and attaching the skeleton bridge sections to front and rear portions of the crane, respectively;

(e) moving the crane and the skeleton bridge sections such that the skeleton section attached to the first portion of the crane approaches a next position;

(f) attaching the skeleton section attached to the front portion of the crane to the bridge structure in the next position;

(g) lowering the legs of the skeleton section attached to the front portion of the crane from the transport position to the extension position and lowering the spud cans;

(h) releasing the skeleton section attached to the rear portion of the crane;

(i) positioning a subsequent skeleton section behind the skeleton section previously attached to the rear portion of the crane;

(j) moving the crane such that the skeleton section previously attached to the rear portion of the crane is adjacent the front portion of the crane and the subsequent skeleton section is adjacent the rear portion of the crane;

(k) attaching the front and rear portions of the crane to the skeleton sections, respectively; and (l) repeating steps (e) through (k) until the bridge structure is completely constructed.

In accordance with still another aspect of the invention, there is provided a counterweight lifting system for lifting and carrying a first payload and a second payload, wherein the counterweight lifting system is movably attachable to the first and second payloads on opposite sides of a centerpoint, and a weight of one of the first and second payloads is used to lift a weight of the other of the first and second payloads.

BRIEF DESCRIPTION OF THE DRAWINGS

These and other aspects and advantages of the present invention will become apparent from the following detailed description of preferred embodiments when taken in conjunction with the accompanying drawings, in which.

DETAILED DESCRIPTION OF PREFERRED EMBODIMENTS

Figure 1:
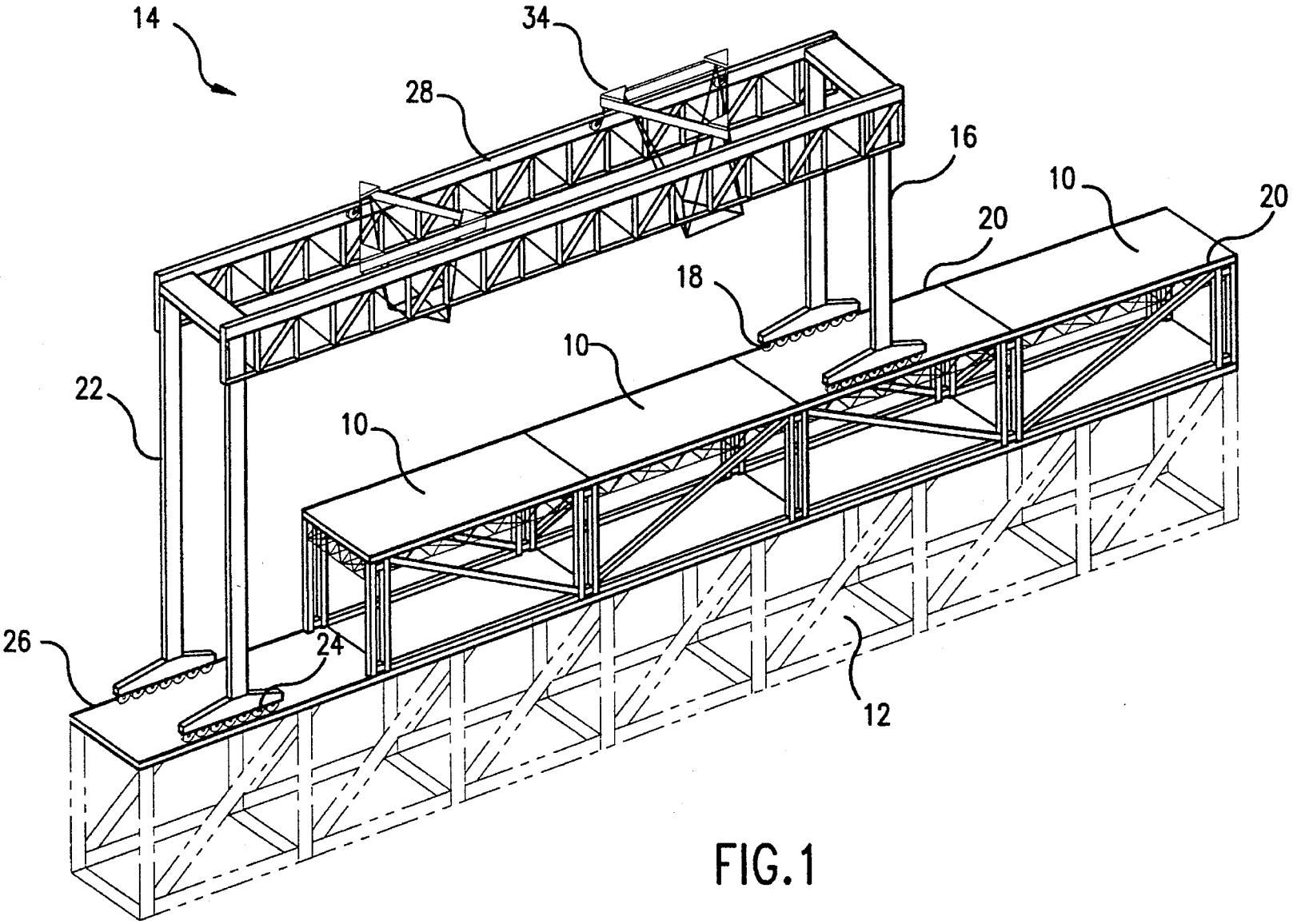
FIG. 1 illustrates a crane in position on a bridge and a first assembled section of an overpass in accordance with a first embodiment of the invention.

Referring to FIG. 1, the construction system of a first embodiment utilizes four preferably 42 foot sections of preassembled overpass 10 that are installed on an initial section of an existing bridge 12 using a conventional crane. The overpass crane 14 is preassembled and installed on the 168 foot section of overpass and the existing bridge as illustrated in FIG. 1.

The overpass crane 14 includes a first frame of supporting legs 16 each comprising wheels 18 adapted to roll on rails 20. A second frame of supporting legs 22 similarly includes wheels 24 for rolling on rails 26. Although wheels 18 and 24 are illustrated in the figures, any suitable structure providing mobility of the crane can be used, and the invention is not meant to be limited thereto. Supporting legs 22 are about two times the length of supporting legs 16 so that the crane 14 maintains an almost level attitude while simultaneously engaging the existing bridge 12 and the overpass sections 10. In one embodiment the legs are adjustable via a telescoping arrangement (shown in phantom in FIG. 1).

Figure 5:
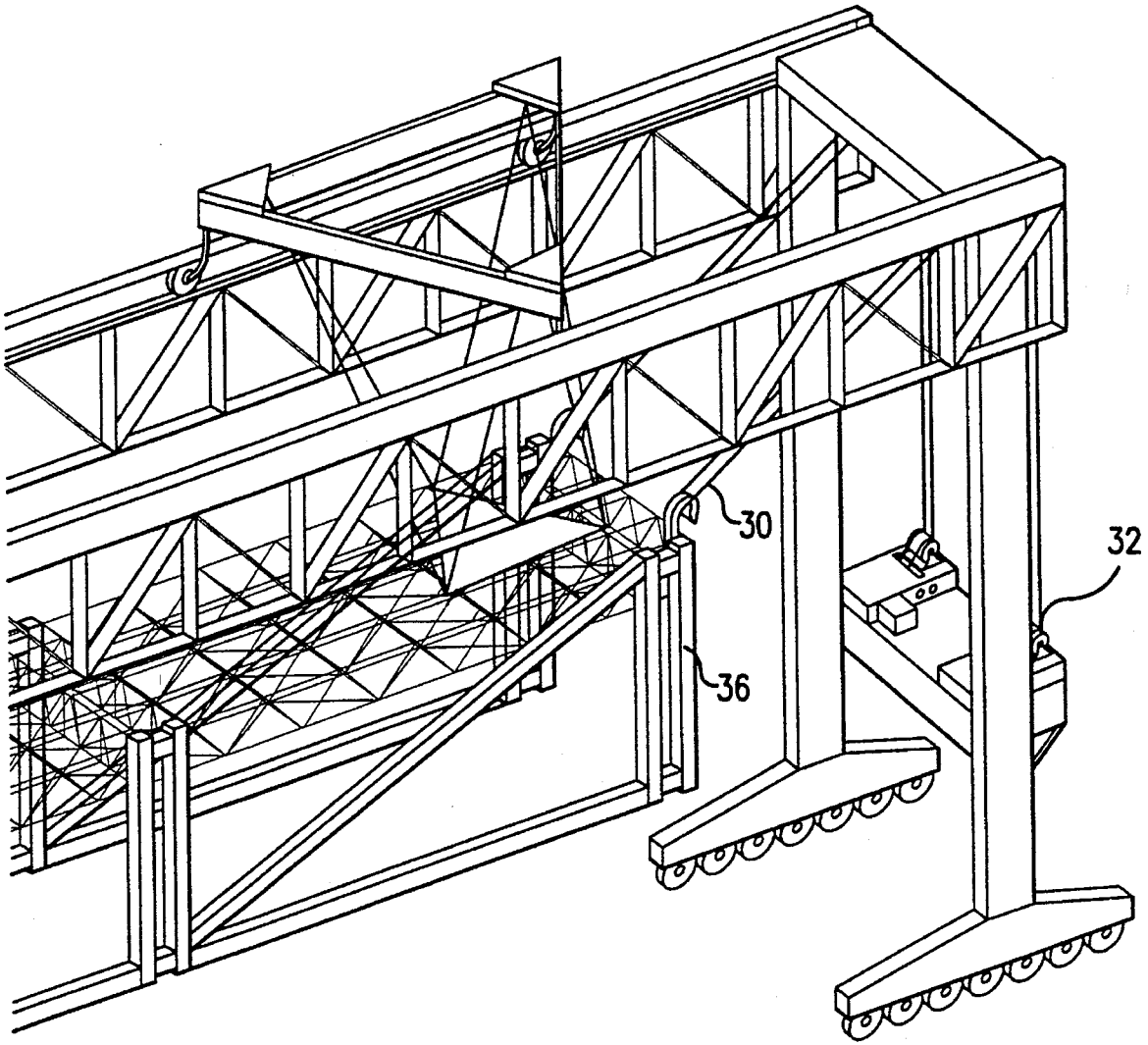
FIG. 5 is a closeup view of the winch and heavy lift cables in the first embodiment.

A longitudinal truss structure 28 is connected between the first and second frames of supporting legs. Referring to FIG. 5, the overpass crane 14 includes heavy lift corner cables 30 disposed at the corners of the crane 14 and driven by a winch 32 disposed on the frame of supporting legs. The longitudinal truss 28 movably supports two light lift platforms 34 that are capable of supporting a load in six degrees of freedom. Such a platform is known in, for example, U.S. Pat. No. 4,666,362 to Landsberger et al. and U.S. Pat. No. 4,883,184 to Albus, the disclosures of which are hereby incorporated by reference.

Figure 2:
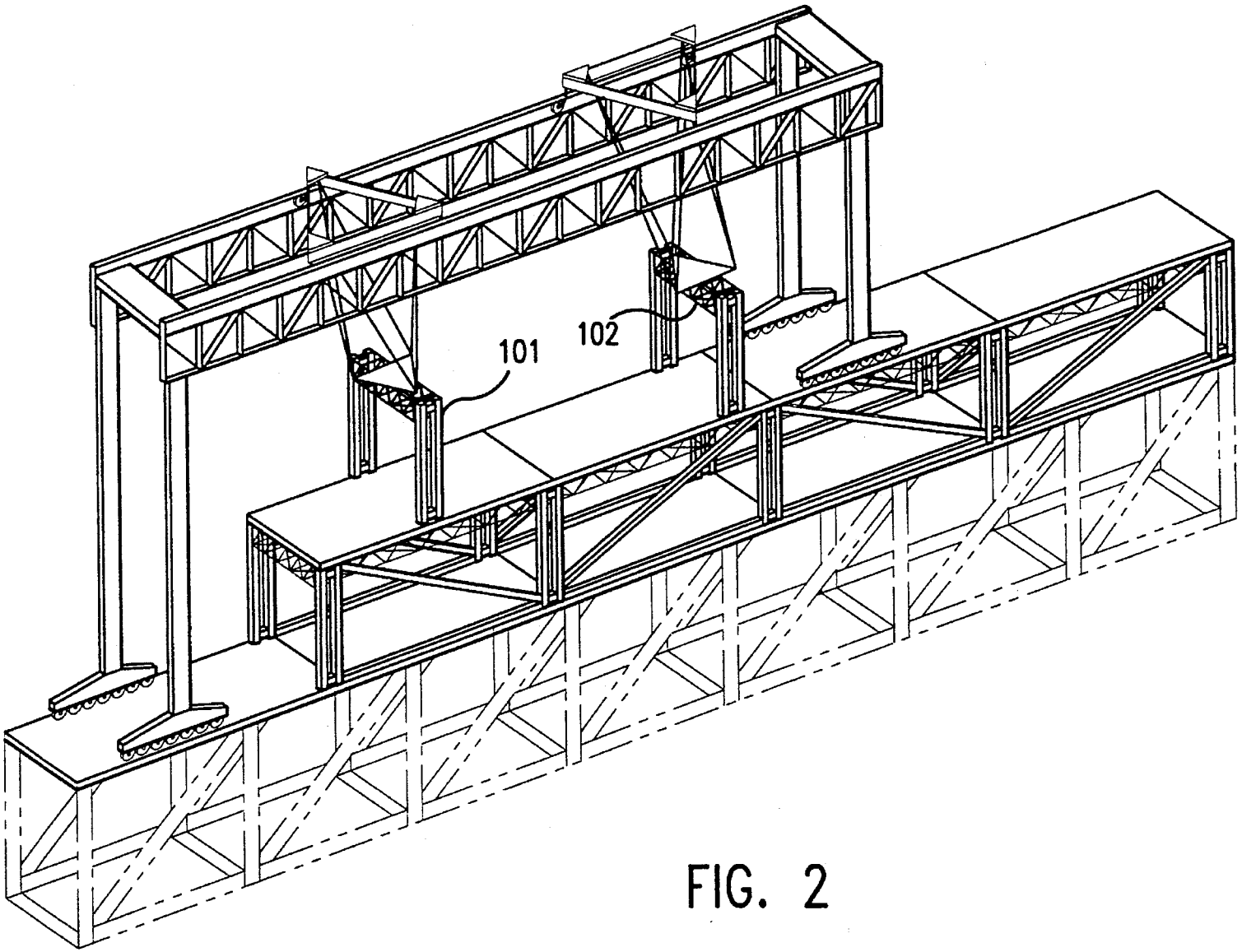
FIG. 2 shows the light-lift platforms assembling overpass components.

The light-lift platforms 34 are used for constructing modular bridge sections in a known manner using an installed overpass section as a staging platform (see FIG. 2). In addition, the light-lift platforms stabilize the assembled skeleton overpass section 36 during transport (see FIG. 3).

Figure 3:
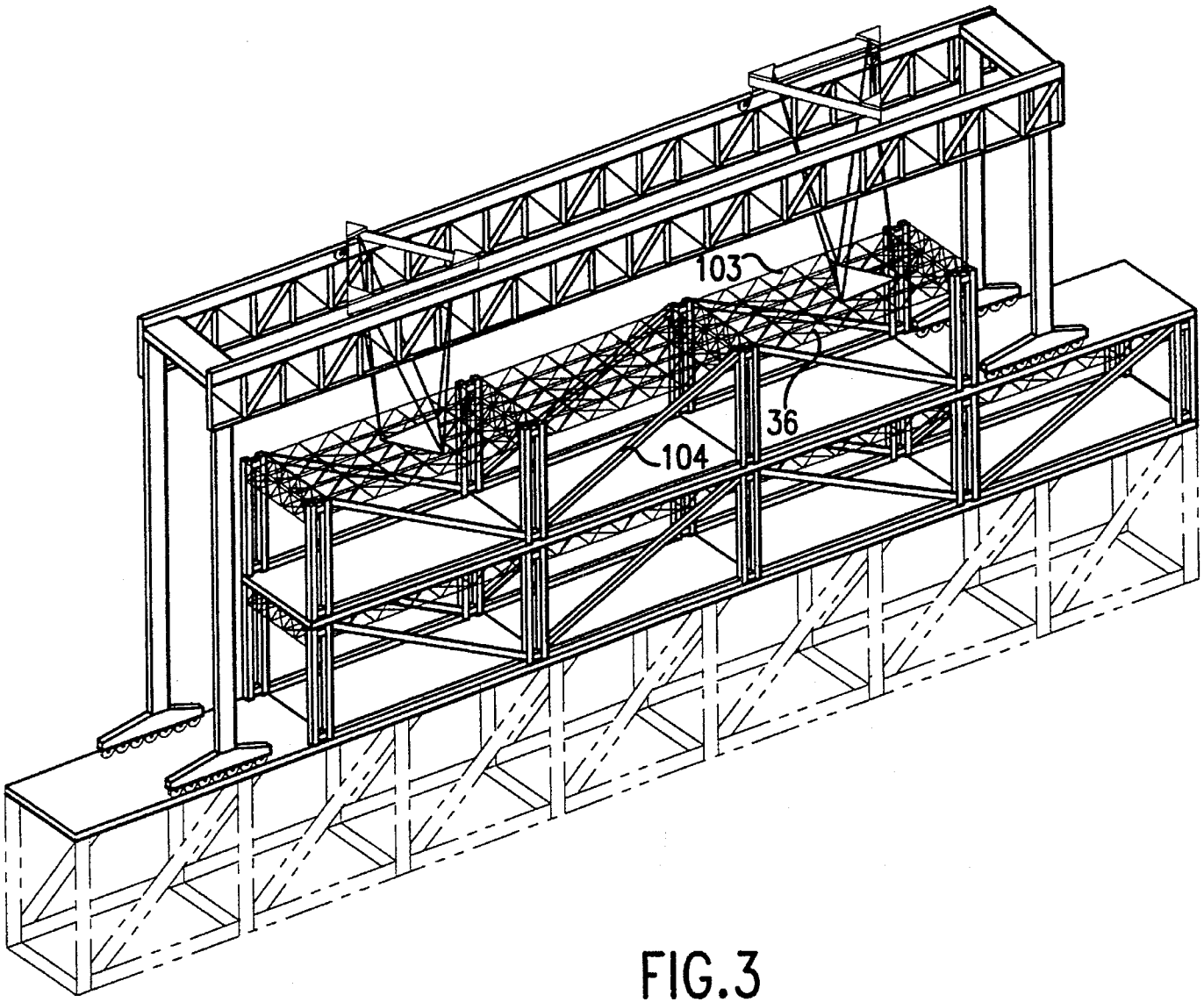
FIG. 3 shows the completed skeleton section of the overpass bridge.
Figure 4:
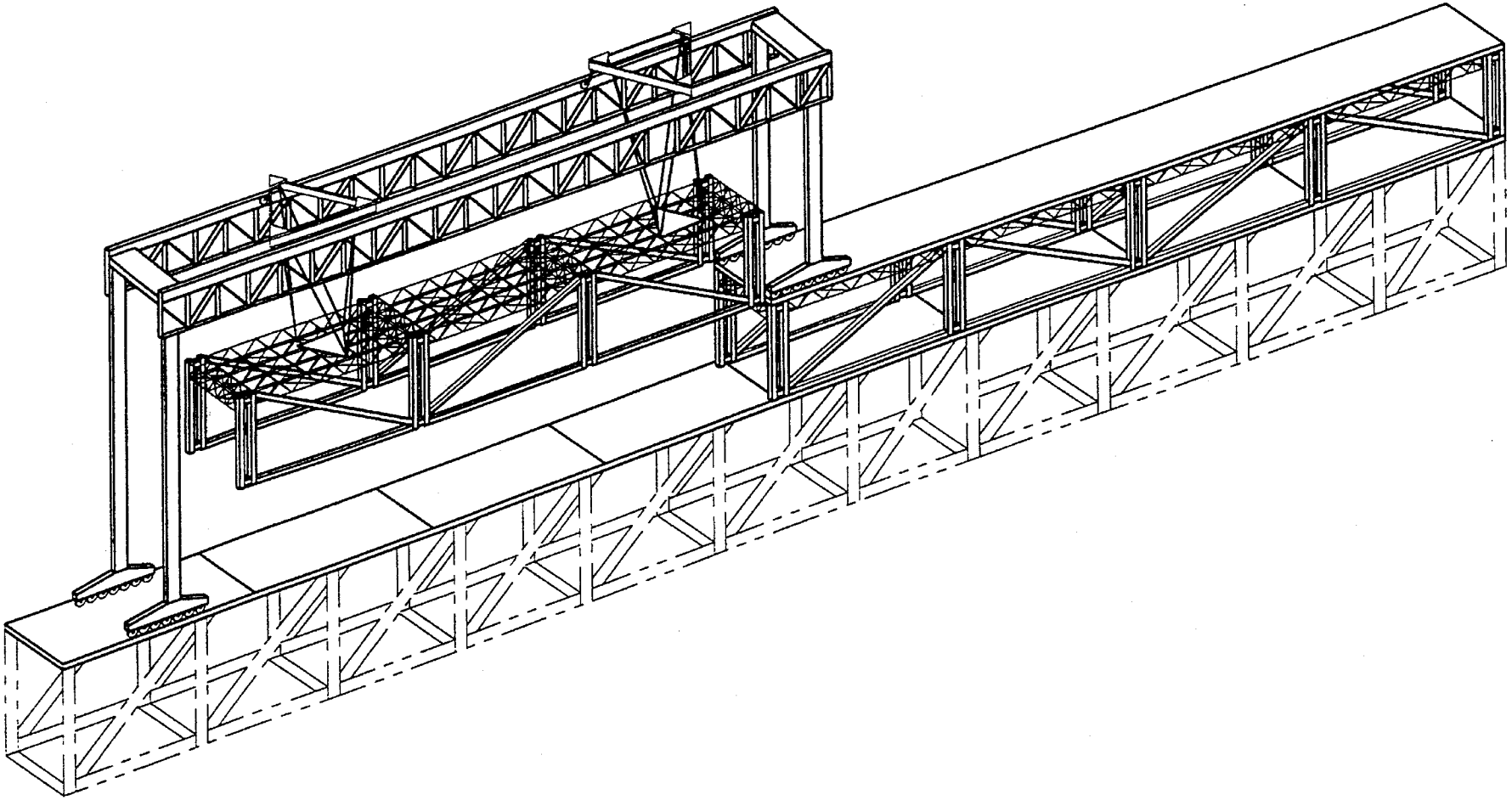
FIG. 4 illustrates the completed skeleton bridge section prior to its attachment to the bridge structure.

Referring to FIGS. 2 and 3, the light-lift platforms assemble columns 101, transverse beams 102, longitudinal trusses 103, and longitudinal ties 104 to complete a skeleton overpass section 36. The heavy-lift corner cables are secured to the completed skeleton preferably using a conventional twist-lock structure such that the completed skeleton overpass section 36 acts as a lifting platform, replacing the heavy spreader bar of the conventional crane. Using the heavy-lift corner cables 30 and winch 32 to lift the skeleton section 36 and the light lift platforms 34 to stabilize the skeleton section 36, the crane 14 is rolled forwardly, carrying the completed skeleton section for attachment in a next position, as illustrated in FIG. 4. The light-lift platforms 34 add deck sections to complete the overpass section. The crane 14 is then ready to construct another skeleton overpass section using the just installed overpass section as a staging platform. The truss structure of the overpass sections is generally known and will not be described in detail. Examples include U.S. Pat. No. 4,907,390 to Tene and U.S. Pat. No. 4,827,688 to Tene, the disclosures of which are hereby incorporated by reference.

Because the overpass crane 14 including supporting leg frames 16,22 rides on rails outside and/or above traffic lanes, the construction system allows overpasses or bypasses to be constructed without interrupting traffic flow all or most of the time.

In one alternative arrangement, the crane is constructed without light lift platforms 34 and includes six to eight corner cables. The corner cables are distributed from each corner to a midpoint of a respective side of the skeleton section 36, providing support for the skeleton section 36 in six degrees of freedom.

Figure 6:
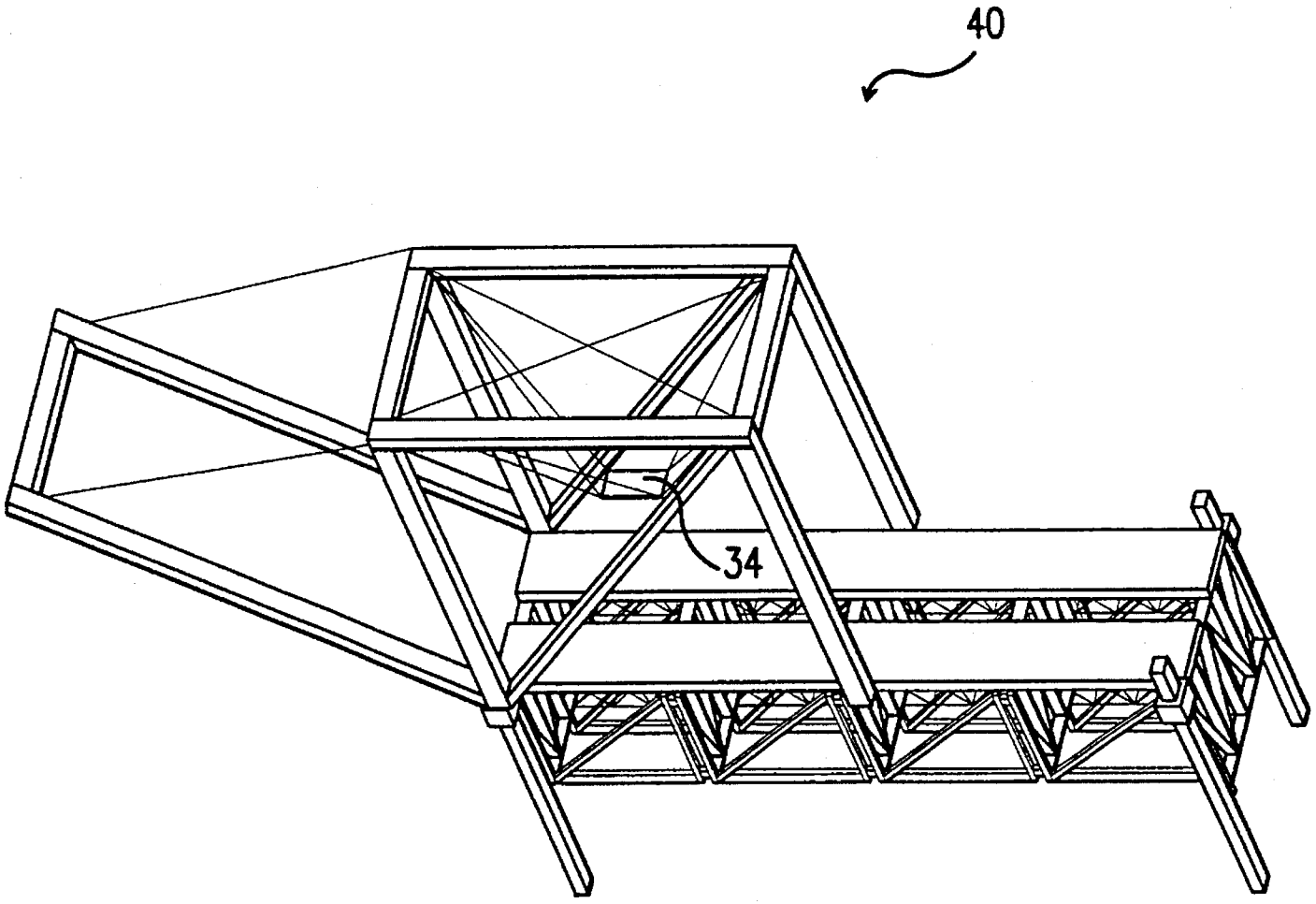
FIG. 6 illustrates a cantilever crane installed on top of a first completed bridge section in accordance with a second embodiment of the invention.
Figure 7:
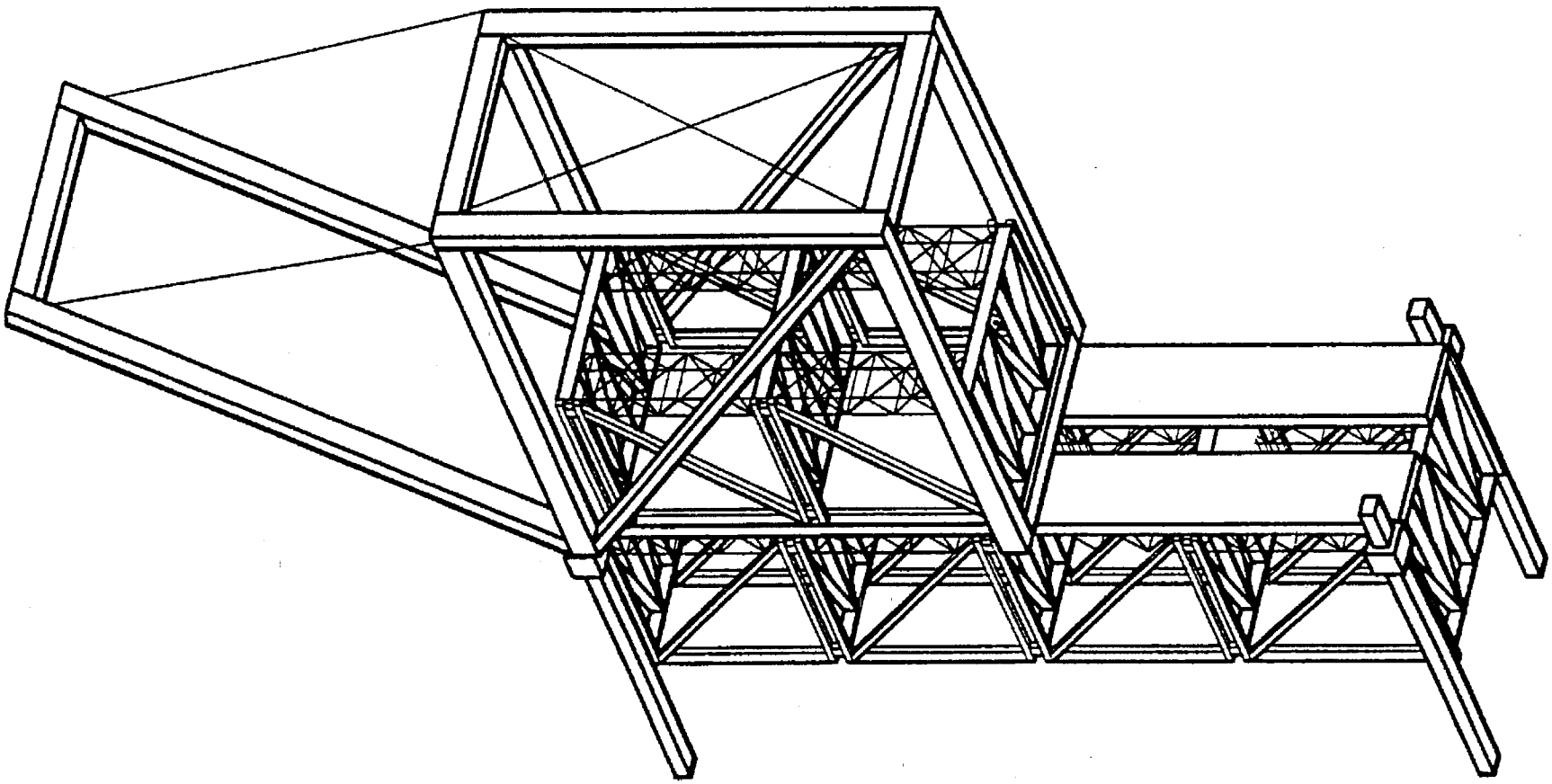
FIG. 7 illustrates the cantilever crane assembling a bridge component skeleton section.
Figure 8:
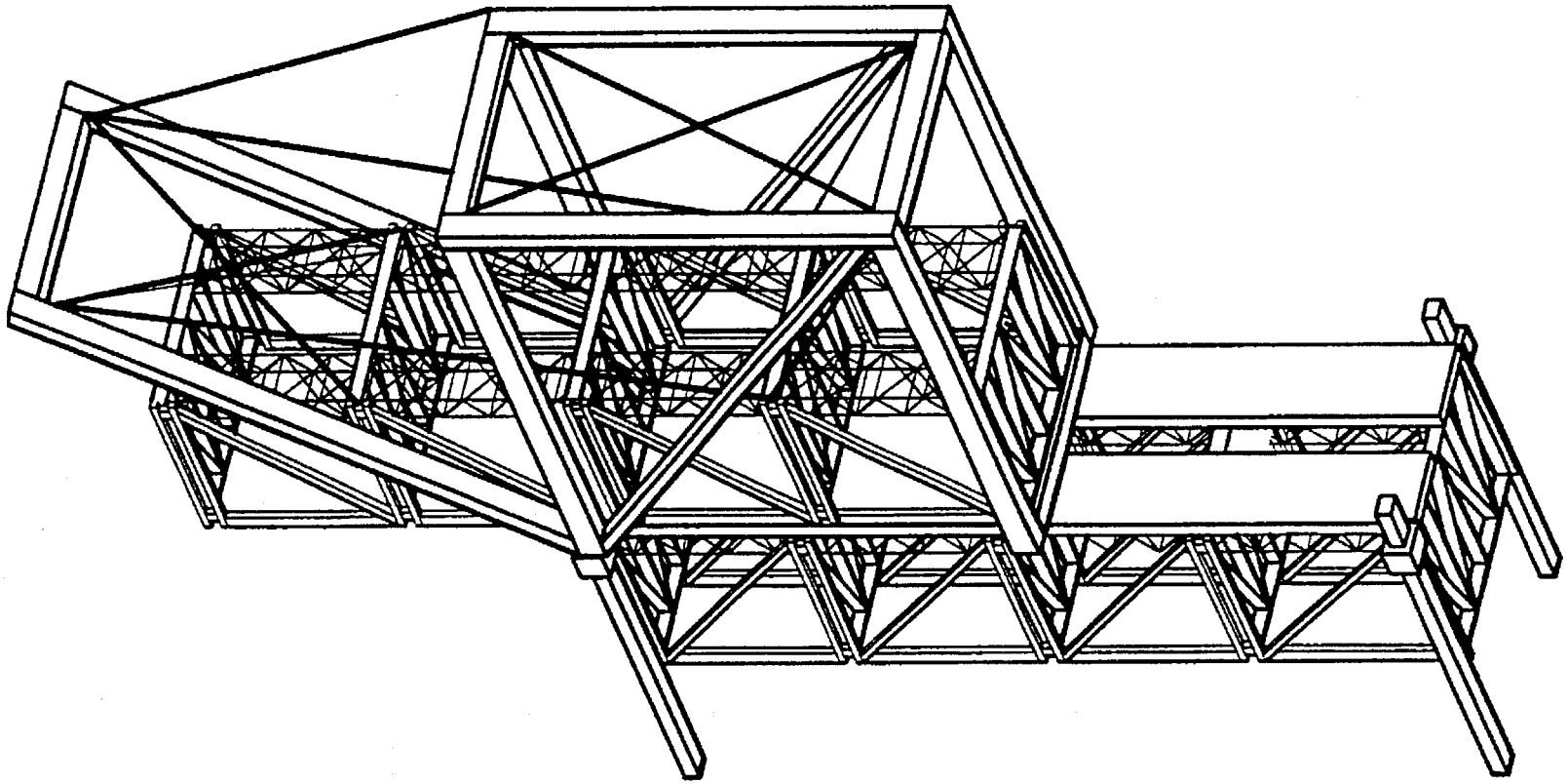
FIG. 8 shows the cantilever crane moving the completed bridge section forward for attachment to the bridge structure.
Figure 9:
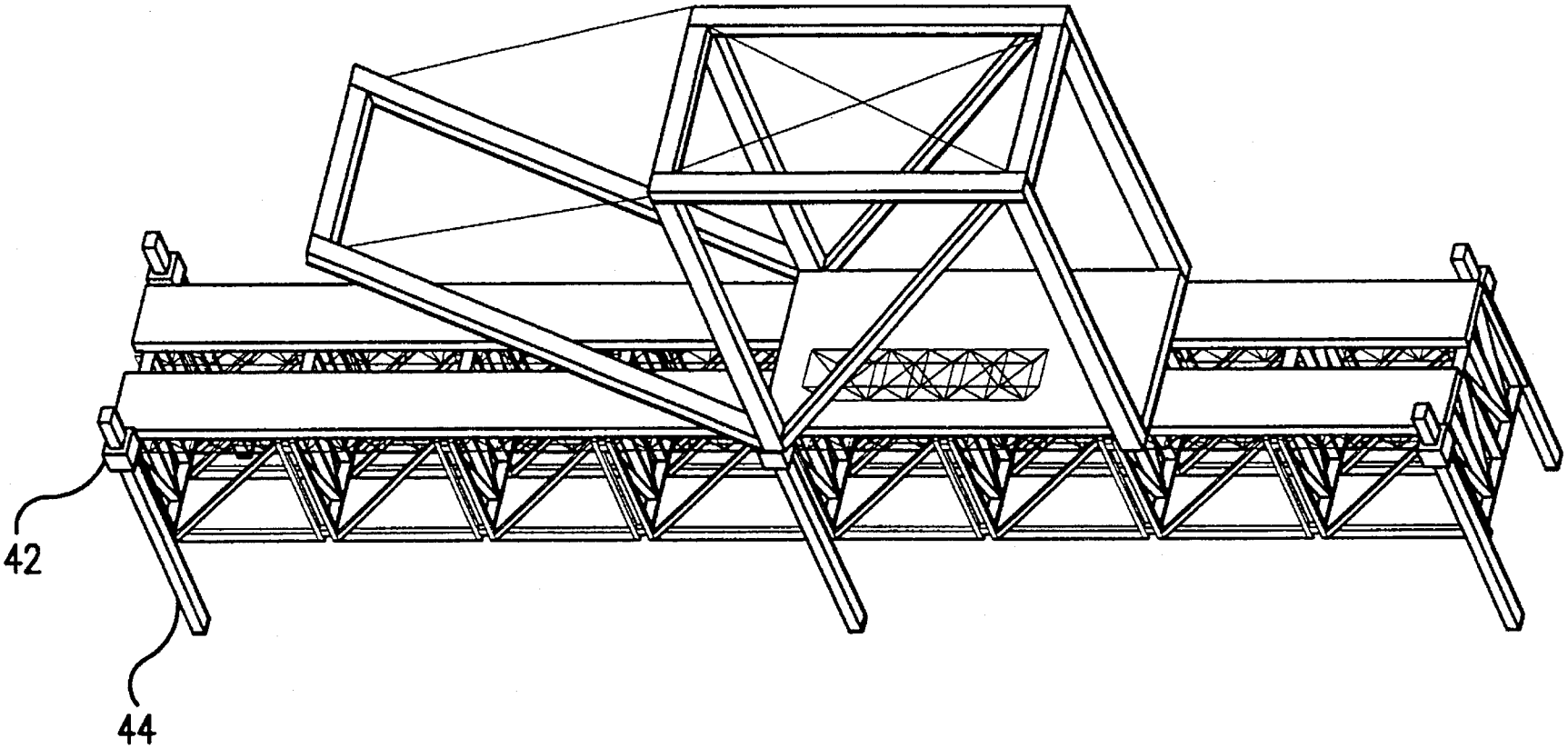
FIG. 9 shows the skeleton section attached to the bridge structure.

Referring to FIG. 6, a construction system of a second embodiment is illustrated in accordance with a cantilever crane 40. In the initial bridge construction, four preferably 42 foot sections of bridge are constructed on land accessible to a conventional crane. The preassembled sections are installed using a conventional crane. A cantilever crane 40 is assembled on top of the completed bridge section as illustrated in FIG. 6. The cantilever crane 40 includes a light lift platform 34 to assemble columns, transverse beams, longitudinal trusses and longitudinal ties as discussed above to complete the skeleton of a preferably 168 foot bridge section as it is pushed forward by a truck or pulled by cables and winches (illustrated in FIG. 7). The light-lift platform 34 also positions and attaches spudwells 42 and pilings 44 to the end of the skeleton section (illustrated in FIG. 9). The cables supporting light-lift platform 34 are reeved around pulleys fixed to corners of the cantilever crane. The heavy-lift cables of the causeway crane are attached to the skeleton using the twist-lock connector described above, and the completed skeleton causeway section is moved forward to a next position as illustrated in FIG. 8. Thus, the completed skeleton acts as a lifting platform, replacing the heavy spreader bar of the conventional crane.

Figure 10:
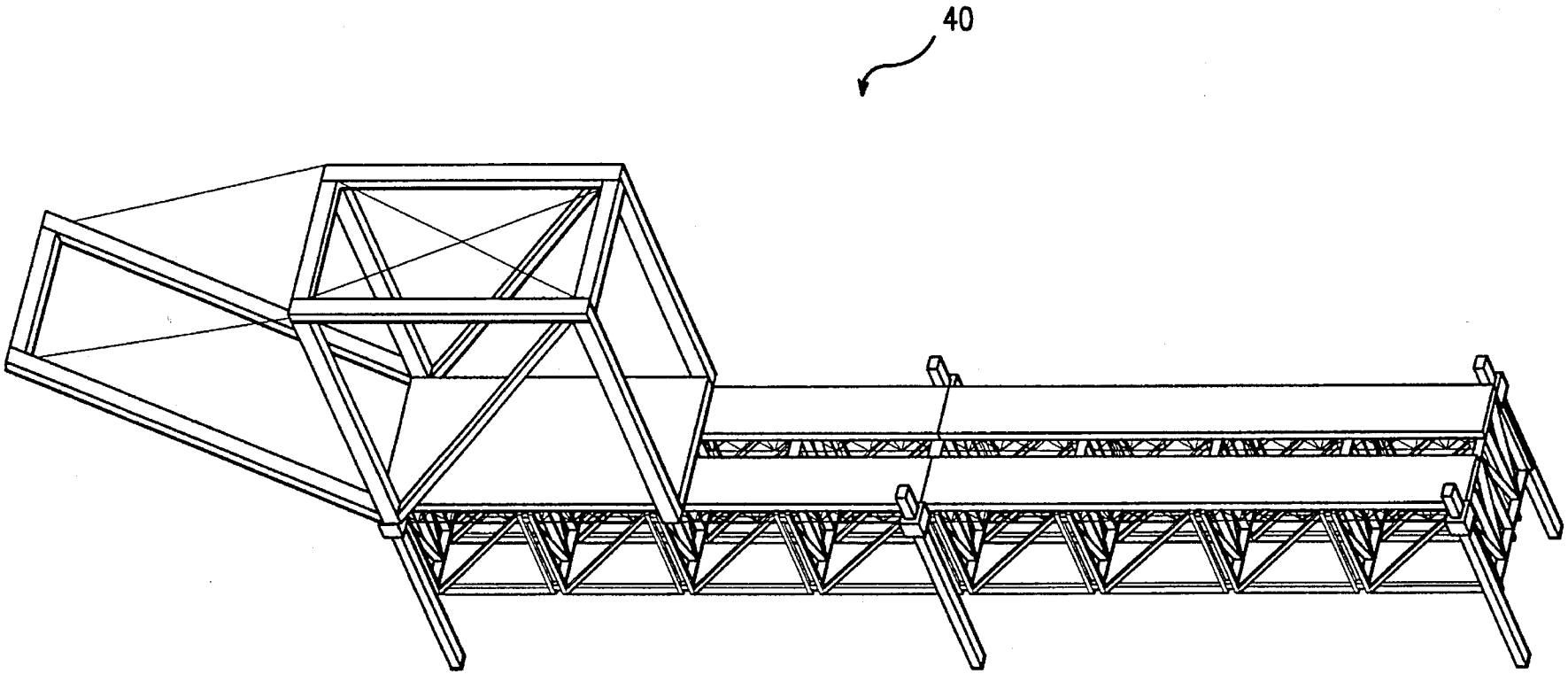
FIG. 10 illustrates the cantilever crane in a next position for .assembly of the next section.

The piles are lowered and driven in a known manner until the causeway section is fully supported. Piles are preferable attached every fourth bridge section. Finally, the causeway section is completed by installing the remainder of the trusses and deck plates. As shown in FIG. 10, the cantilever causeway crane 40 is then moved forward to the end of the completed section.

The frame components are preferably formed of axially loaded structural elements to substantially reduce the weight of the structure supporting the payload, pulleys and winches, its own weight, windloads and dynamic effects caused by moving the payload and the like during the assembly process. As a result, the maximum load supported by the substructure and foundations during the construction process is preferably no greater than their load bearing capacity during operation. The crane structure is designed with axially loaded structural elements carrying the main vertical loads. By having the main lifting cables attached to the four corners of the crane structures, the load is transferred directly to the legs, and axial loads are introduced to the top members of the frames of supporting legs and top members of the longitudinal trusses 28. The light lift platforms, used to assemble much lighter components, are likewise made of cables and axially loaded elements. Axially loaded elements, cables and trusses utilize the maximum allowable stresses over their whole section and are therefore lighter and more effective than bending elements (beams) where the maximum allowable stresses are utilized only at extreme edges or corners. This design criteria leads to lighter structure of the overpass bridge, which in turn enables reduction in weight of the lifting equipment and reduction of the additional loads imposed on the existing bridge.

These weight savings can be applied to achieve cost savings, reduced construction time and increase the span of bridges and causeways.

Figure 11:
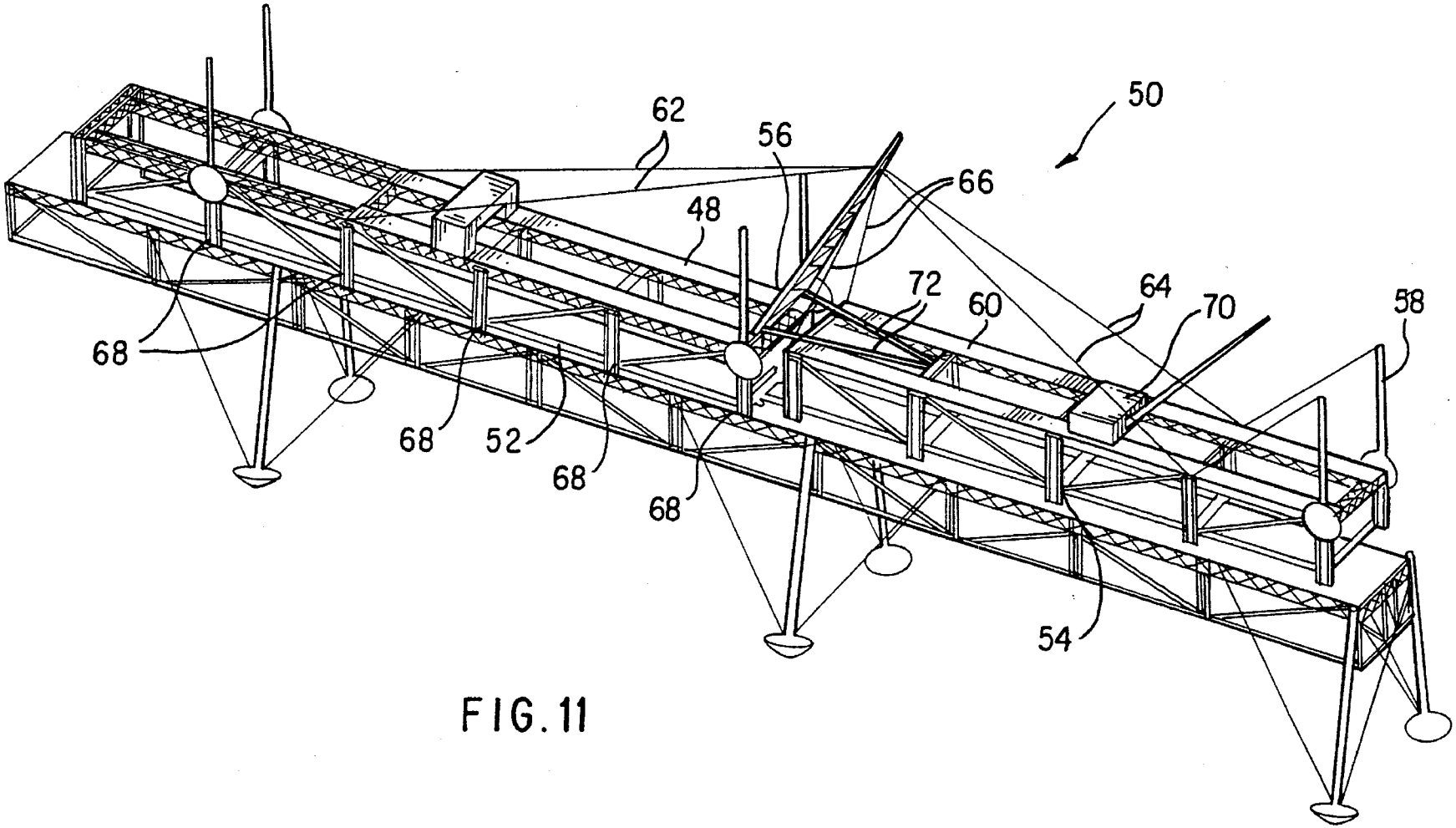
FIG. 11 illustrates a counterweight crane carrying a skeleton section positioned on top of a skeleton causeway section in accordance with a third embodiment of the invention.

Referring to FIG. 11, a construction system of a third embodiment is illustrated in accordance with a counterweight bridge crane 50. In this construction, two or more complete, preferably 168 foot bridge or causeway sections are assembled by conventional cranes where there is access such as on land, on a quay, or from a ship or barge. After installation of the preassembled sections, two skeleton sections, preferably each 168 feet long, are assembled on top of the completed bridge or causeway. As shown in FIG. 11, the counterweight crane 50 is assembled on top of the skeleton section. The counterweight crane rear frame 48 is attached to the rear section 52 of the skeleton section while the front frame 60 of the counterweight crane is attached to the front section 54.

Wheels 68' fixed to counterweight crane 50 are disposed above and below a rail fixed to the skeleton sections. Wheels 68' are selectively lockable on the rail to prevent movement.

The rear frame 48, supported by rear cables 62 attached to the top of center frame 56 utilizes the weight of skeleton section 52 and additional bridge components like decks and nestable trusses as counterweight for lifting and lowering into place the front skeleton section 54. The front skeleton section 54 is suspended from the crane front frame 60 and the center cables 66. The front frame is supported to the top of center frame 56 by front cables 64. Skeleton section 52 rides on the assembled bridge using wheels 68 or the like. A service car with crane 70 can move on the front frame 60 to assist in connecting the center cables 66 to the front skeleton section 54 and in lowering the front legs 58.

The two skeleton sections 52 and 54 together with the counterweight crane 50 are rolled forward on wheels 68, to the new position (FIG. 12) where section 54 is above its final position in the bridge. A new, preferably 168 foot skeleton section 74 is then attached to the rear of skeleton section 52.

Figure 12:
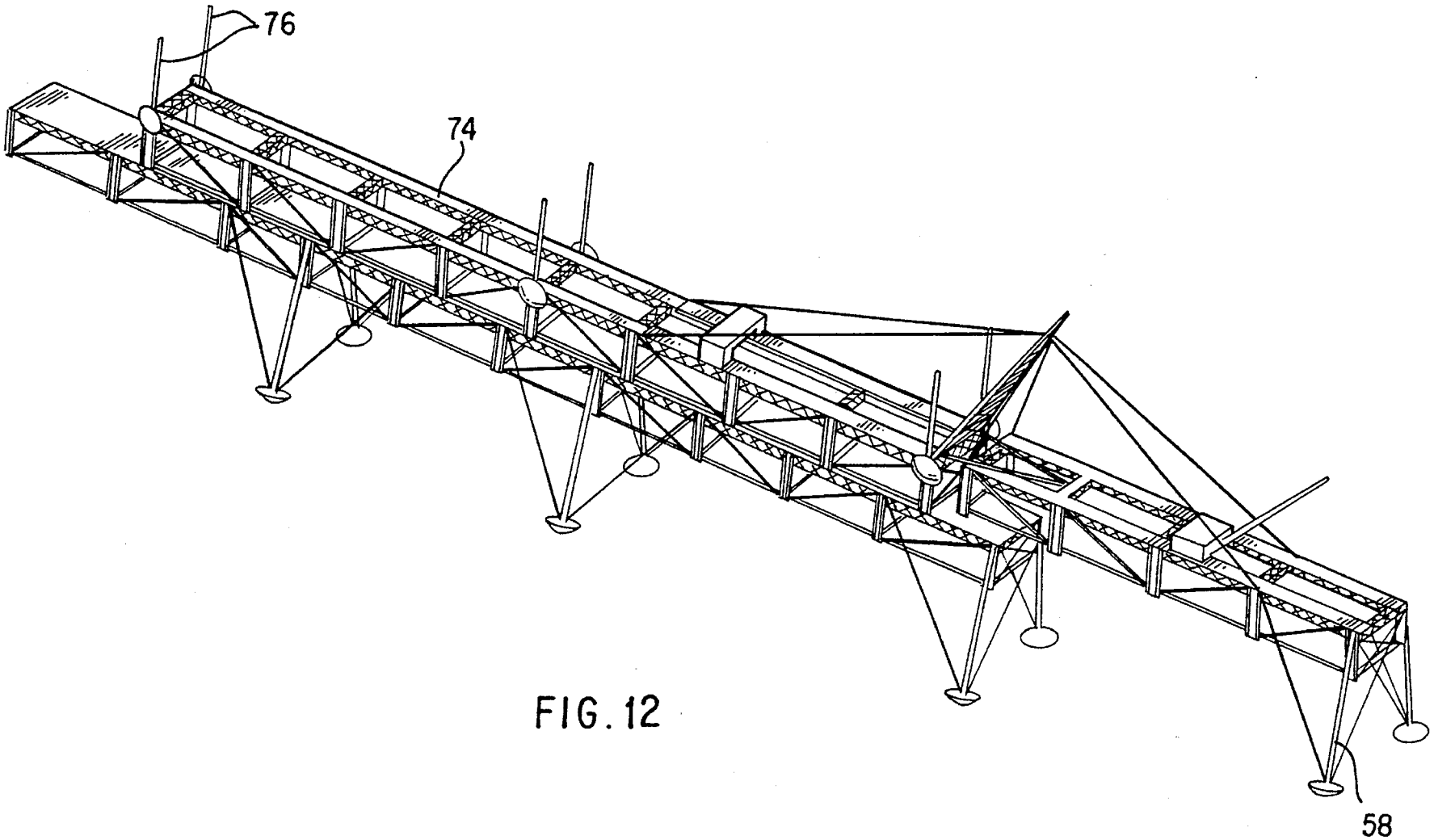
FIG. 12 shows the counterweight crane advancing the skeleton section to a next position.
Figure 13:
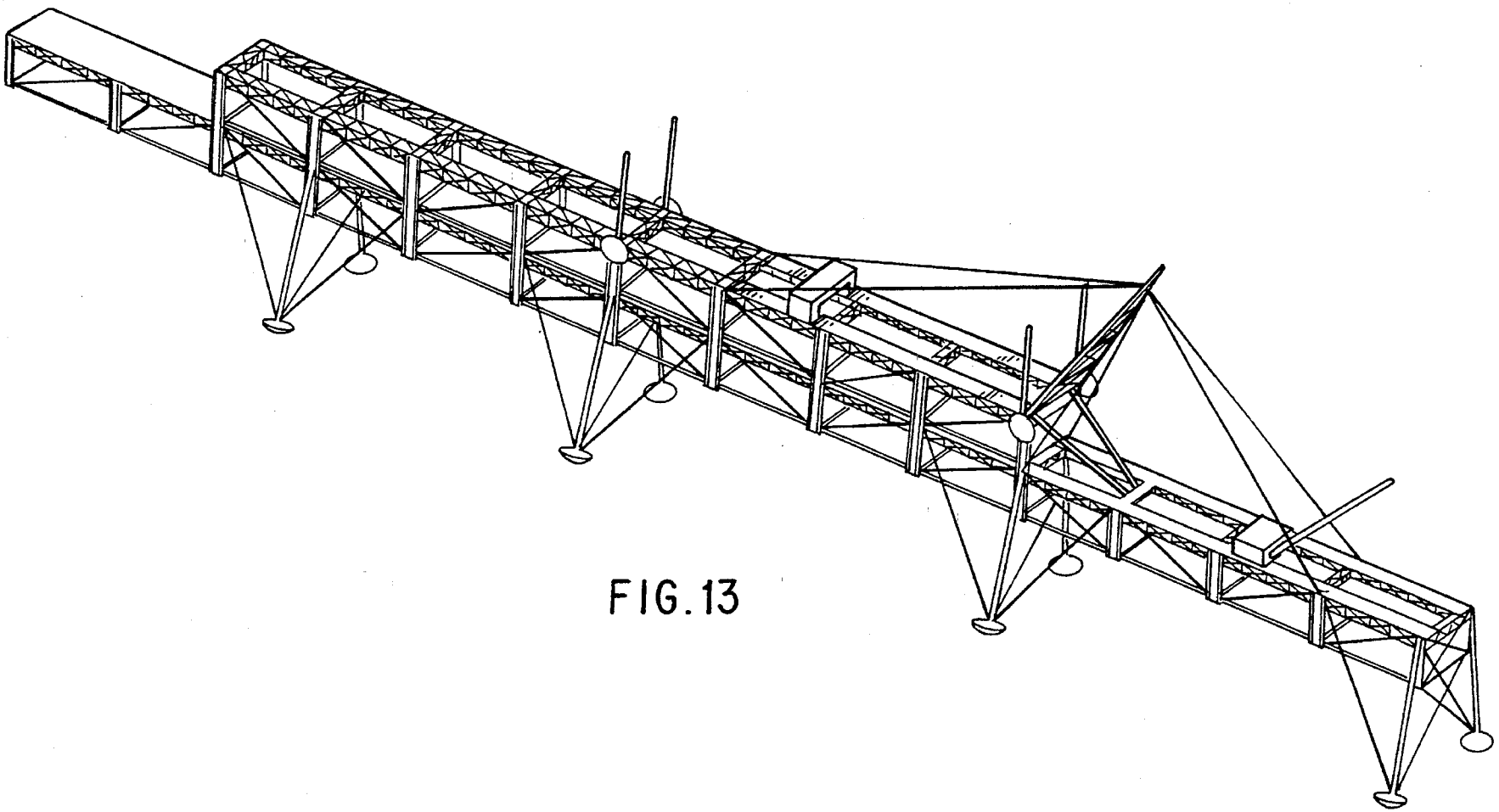
FIG. 13 shows the skeleton section attached to the bridge structure.

Referring to FIG. 12, as the crane 50 together with the first skeleton section 52 and the second section 54 are rolled forward, spud cans and legs 58 are lowered from a transport position (FIG. 11) to an extension position (FIGS. 12 and 13). The counterweight crane 50 lifts the second section 54 of the skeleton, pushes it forward using compression rods 72, and lowers it into final position as shown in FIG. 13 using the rear section 52 as additional counterweight. The forward ends of the compression rods 72 are disconnected, and the front legs are adjusted to fully support skeleton section 54.

Figure 14:
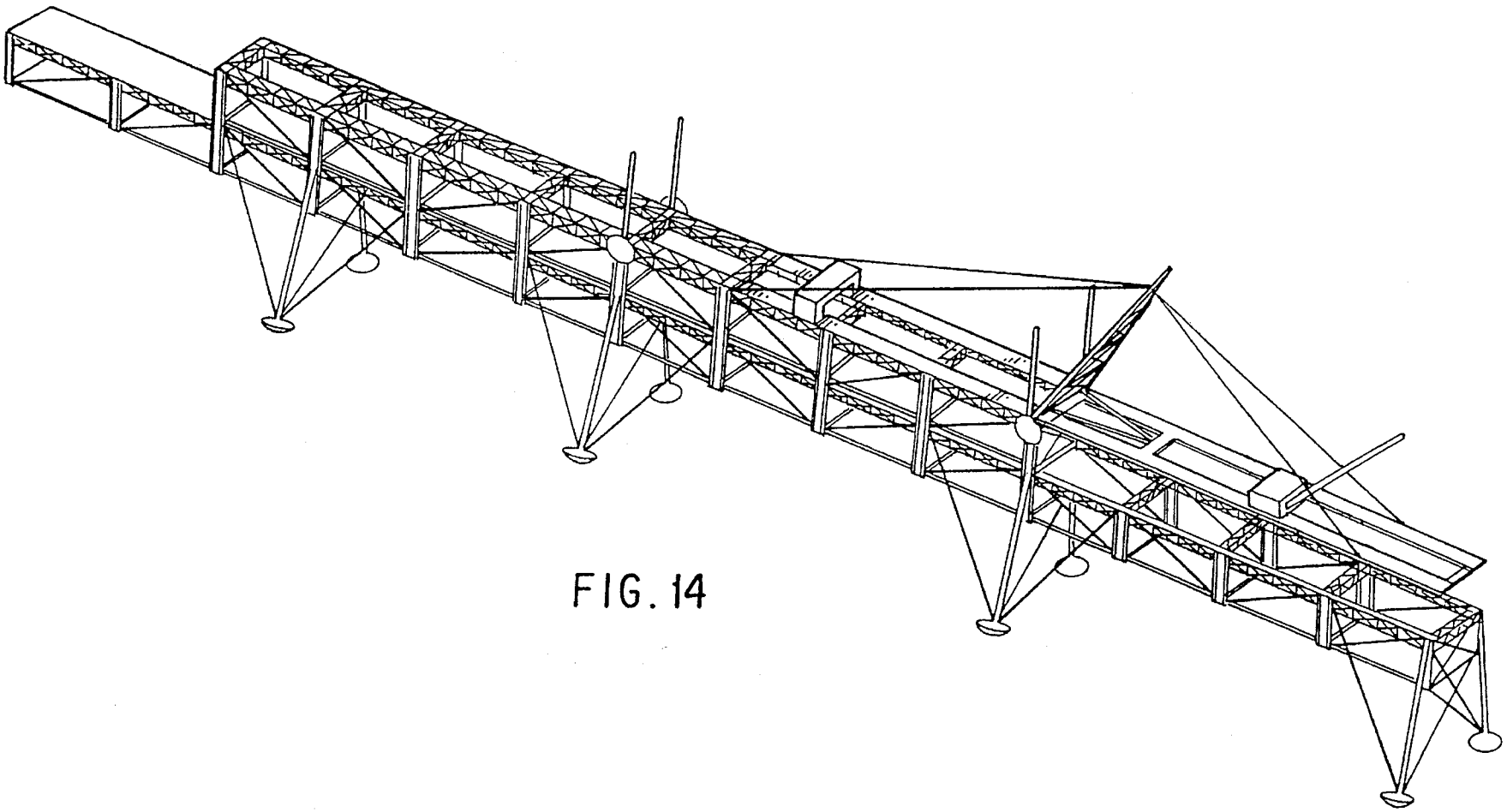
FIG. 14 shows the causeway counterweight crane separated from the attached skeleton section and ready to move backward and receive a new skeleton section.

The front frame 60 and service car 70 are lifted back using the front cables 64 and center cables 66 using a compression rods 72 (FIG. 14). Additional legs and spud cans 76 are attached to the new skeleton section 74, and the counterweight crane 50 is disconnected from skeleton section 52 and rolled backward. The crane 50 is attached to skeleton section 74 and the cycle repeats itself with section 52 becoming the "new" section 54 and section 74 becoming the "new" section 52. The crane 50 together with the two bridge skeleton sections 52 and 74 ("new" 52, 54) are rolled forward to the same position described in FIG. 11.

While the invention has been described in detail with reference to preferred embodiments thereof, which are intended to be illustrative but not limiting, various modifications of the present invention may be made without departing from the spirit and scope of the invention, which is defined by the following claims.

What is claimed is:

1. A crane capable of lifting and carrying modular bridge sections for overpass bridge construction, the crane comprising:

a first supporting leg frame including a first pair of supporting legs, each of said legs comprising structure providing mobility of said crane and having a first length;

a second supporting leg frame including a second pair of supporting legs, each of said legs comprising structure providing mobility of said crane and having a second length, longer than said first length; and a plurality of trusses connected between said first and second pairs of supporting leg frames, said trusses supporting heavy-lift corner cables capable of lifting and carrying said modular bridge sections;

wherein said first supporting leg frame is movable on an installed bridge section fixed to an existing section and wherein said second supporting leg frame is movable on said existing section.

2. A crane according to claim 1, further comprising at least one light-lift platform movably supported by said trusses, said at least one light-lift platform capable of assembling said modular bridge sections.

3. A crane according to claim 1, comprising four heavy-lift corner cables, each of said cables disposed at a corner section of said crane, each said cables being driven by a winch.

4. A crane according to claim 1, comprising at least six heavy-lift corner cables supporting said modular bridge sections in six degrees of freedom.

5. A crane according to claim 1, comprising two light-lift platforms, said light-lift platforms stabilizing said modular bridge sections during transport of said modular bridge sections.

6. A crane according to claim 1, wherein said structure providing mobility comprises wheels.

7. A crane according to claim 1, wherein a length of at least one of said first and second supporting leg frames is adjustable.

8. A crane according to claim 1, wherein said second pair of supporting legs are approximately twice as long as said first pair of supporting legs.

9. A crane according to claim 1, wherein said first and second pairs of supporting legs, said frame and said at least one light-lift platform have a combined load rating less than a load rating capacity of said bridge construction.

10. A lifting system comprising a plurality of cables and carrying a payload, said cables arranged to support said payload in six degrees of freedom, wherein said payload is used as a lifting platform.

11. A method of constructing a bridge structure using a crane, the crane comprising structure capable of lifting and carrying modular bridge sections, the method comprising the steps of:

(a) assembling an initial bridge section having a predetermined length;

(b) installing said initial bridge section;

(c) placing said crane on said initial bridge section;

(d) assembling with said crane a subsequent bridge section using one of said initial bridge section and a previous subsequent bridge section as a staging platform;

(e) lifting said subsequent bridge section with said crane and stabilizing said subsequent bridge section;

(f) moving and carrying said subsequent bridge section to a next position;

(g) attaching said subsequent bridge section to said bridge structure; and (h) repeating steps (d) through (g) until said bridge structure is completely constructed.

12. A method according to claim 11, wherein said crane comprises at least one light-lift platform, said lifting and stabilizing step comprising stabilizing said subsequent bridge section in six degrees of freedom.

13. A method according to claim 11, wherein said crane comprises a plurality of heavy-lift corner cables, said lifting step comprising securing said heavy-lift corner cables to said subsequent bridge section and lifting said subsequent bridge section with said cables.

14. A method according to claim 13, wherein said moving and carrying step comprises rolling said crane on a wheel assembly to said next position.

15. A method according to claim 11, wherein said moving and carrying step and said attaching step comprise positioning and attaching spudwells and pilings to an end of said subsequent bridge section.

16. A method according to claim 15, further comprising driving said pilings until said subsequent bridge section is fully supported.

17. A method according to claim 11, wherein said assembling step comprises assembling two skeleton sections on top of said initial bridge section, said placing step comprising placing said crane on sides of said skeleton sections such that said crane supports each of said skeleton sections on opposite sides thereof, each of said skeleton sections comprising legs with spud cans displaceable between a transport position and an extension position, and wherein prior to said attaching step, the method comprising lowering said legs from said transport position to said extension position.

18. A method according to claim 11, wherein said crane is a cantilever crane.

19. A method according to claim 11, wherein said crane is a counterweight crane.

20. A method of constructing a bridge structure using a crane, the crane comprising structure capable of lifting and carrying modular bridge sections, the method comprising the steps of:

(a) assembling an initial bridge section having a predetermined length;

(b) installing said initial bridge section;

(c) assembling two skeleton bridge sections on said initial bridge section, said two skeleton bridge sections each having supporting legs with spud cans displaceable between a transport position and an extension position;

(d) placing said crane on said two skeleton bridge sections and attaching said skeleton bridge sections to front and rear portions of said crane, respectively;

(e) moving said crane and said skeleton bridge sections such that said skeleton section attached to said first portion of said crane approaches a next position;

(f) attaching said skeleton section attached to said front portion of said crane to said bridge structure in said next position;

(g) lowering said legs of said skeleton section attached to said front portion of said crane from said transport position to said extension position and lowering said spud cans;

(h) releasing said skeleton section attached to said rear portion of said crane;

(i) positioning a subsequent skeleton section behind said skeleton section previously attached to said rear portion of said crane;

(j) moving said crane such that said skeleton section previously attached to said rear portion of said crane is adjacent said front portion of said crane and said subsequent skeleton section is adjacent said rear portion of said crane;

(k) attaching said front and rear portions of said crane to said skeleton sections, respectively; and (1) repeating steps (e) through (k) until said bridge structure is completely constructed.

* * * * *